US009037066B2

(12) United States Patent
Nakamura

(10) Patent No.: US 9,037,066 B2
(45) Date of Patent: May 19, 2015

(54) IMAGE FORMING APPARATUS

(71) Applicant: Konica Minolta, Inc., Tokyo (JP)

(72) Inventor: Masakazu Nakamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 229 days.

(21) Appl. No.: 13/918,126

(22) Filed: Jun. 14, 2013

(65) Prior Publication Data

US 2013/0336693 A1 Dec. 19, 2013

(30) Foreign Application Priority Data

Jun. 18, 2012 (JP) ..... 2012-136821

(51) Int. Cl.
*G03G 21/00* (2006.01)

(52) U.S. Cl.
CPC ..... *G03G 21/0094* (2013.01); *G03G 21/0005* (2013.01); *G03G 21/0035* (2013.01)

(58) Field of Classification Search
CPC ..... G03G 21/0005; G03G 21/0035; G03G 21/0094
USPC ..... 399/346
See application file for complete search history.

(56) References Cited

U.S. PATENT DOCUMENTS

2008/0181689 A1* 7/2008 Fujimori ..... 399/346

FOREIGN PATENT DOCUMENTS

JP 2007-193183 8/2007
JP 2011-180397 9/2011

* cited by examiner

*Primary Examiner* — David Gray
*Assistant Examiner* — Andrew V Do
(74) *Attorney, Agent, or Firm* — Lucas & Mercanti, LLP

(57) ABSTRACT

Provided is an image forming apparatus including: an image bearing member on which a toner image is formed electrophotographically; and a lubricant applying section that applies a lubricant to a surface of the image bearing member. The lubricant applying section includes two columnar solid lubricants that contain a larger number of residual gas bubbles at one end than the other end thereof, and are produced by the same production method. The two solid lubricants are placed along an axial direction of the image bearing member such that the respective one and the other ends thereof are opposite to each other.

3 Claims, 4 Drawing Sheets

IMAGE FORMING APPARATUS

CROSS REFERENCE TO RELATED APPLICATIONS

This application is entitled to and claims the benefit of Japanese Patent Application No. 2012-136821, filed on Jun. 18, 2012, the disclosure of which including the specification, drawings and abstract is incorporated herein by reference in its entirety.

BACKGROUND OF THE INVENTION

1. Field of the Invention

The present invention relates to an electrophotographic image forming apparatus, and more particularly, to an image forming apparatus including a lubricant applying section that applies a lubricant to image bearing members such as a photoconductor and an intermediate transfer member.

2. Description of Related Art

In general, electrophotographic image forming apparatus (such as printers, copiers, and facsimile machines) are configured to irradiate (expose) a charged photoconductor with laser light according to the image data to form thereon an electrostatic latent image. The electrostatic latent image is then visualized by supplying toner from a developing device to the photoconductor (image bearing member) on which the electrostatic latent image is formed, whereby a toner image is formed. The toner image is then directly or indirectly transferred onto a sheet, heated and pressurized for fixing to form an image on the sheet.

Toner that remains on the surface of a photoconductor drum after transfer (i.e., residual toner) is collected by a cleaning device. The cleaning device includes a cleaning blade that is made of an elastic body and is placed in sliding contact with the surface of the photoconductor drum. The residual toner is scraped by the cleaning blade, whereby the surface of the photoconductor drum is cleaned.

In the cleaning process, because the photoconductor drum is rotated with the cleaning blade being in sliding contact therewith, a frictional force is generated at the sliding-contact portion between the photoconductor drum and the cleaning blade, resulting in unwanted ablation of the photoconductor drum and cleaning blade. In an effort to reduce such a frictional force at the sliding-contact portion, image forming apparatus have been proposed that are configured to apply a lubricant to the surface of the photoconductor drum (see, e.g., Japanese Patent Application Laid-Open Nos. 2011-180397 and 2007-193183).

In general, when a lubricant is applied to a photoconductor drum, a lubricant applying brush is fixed in sliding contact with the photoconductor drum, and a solid lubricant is placed so as to be pressed against the lubricant applying brush. The lubricant applying brush is then rotated allowing the solid lubricant to be scraped off and applied to the photoconductor drum.

The solid lubricant is formed as a column for example by the gravity casting method, wherein a cylindrical mold is placed upright such that the axial direction thereof is vertical, a liquid resin is poured into the mold so as to fill the mold by its weight, and the resin is allowed to solidify.

Upon production of a solid lubricant by the gravity casting method, dissolved gas appears in the form of gas bubbles during the solidification of the resin. As the resin gradually solidifies from the bottom side, the gas bubbles migrate upward through the resin to the surface. However, some of the gas bubbles remain trapped in the resin. Accordingly, while one end in the axial direction of the solid lubricant (hereinafter, bottom-side end) corresponding to the bottom side during the production of the solid lubricant is formed in solid form, at the other end in the axial direction of the solid lubricant (hereinafter, pouring-side end) corresponding to the top side (pouring side) during the manufacture of the solid lubricant, gas bubbles remain trapped, and so-called blowholes are likely to occur. That is, the lubricant density of the pouring-side end is lower than that of the bottom-side end due to the occurrence of the blowholes.

In recent years, a photoconductor drum unit unitized by including a photoconductor drum, a cleaning device, and the like is required to have a longer service life. In order to meet this requirement, an increase in size of a solid lubricant has been developed. Consequently, blowholes are further likely to occur in the pouring-side end of the solid lubricant.

If blowholes occur in the solid lubricant as described above, the amount of lubricant applied to the photoconductor drum becomes partially insufficient, and abrasion and deterioration of the photoconductor drum or the cleaning blade are accelerated. Further, in order to achieve still higher definition and higher image quality, more uniform lubricant application is required, but it is unfortunately difficult to meet this requirement.

SUMMARY OF THE INVENTION

An object of the present invention is to provide an image forming apparatus capable of uniformly applying a lubricant to an image bearing member such as a photoconductor drum, improving the durability and reliability of a photoconductor drum unit, and achieving higher image quality.

To achieve at least one of the above-mentioned objects, an image forming apparatus reflecting one aspect of the present invention includes an image bearing member configured to form thereon a toner image electrophotographically; and a lubricant applying section configured to apply a lubricant to a surface of the image bearing member. The lubricant applying section includes two columnar solid lubricants each containing a larger number of residual gas bubbles at one end than at the other end thereof, the two solid lubricants being formed by the same production method. The two solid lubricants are placed in parallel to an axial direction of the image bearing member such that the respective one and the other ends thereof are opposite to each other.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the accompanying drawings.

Figure 1:
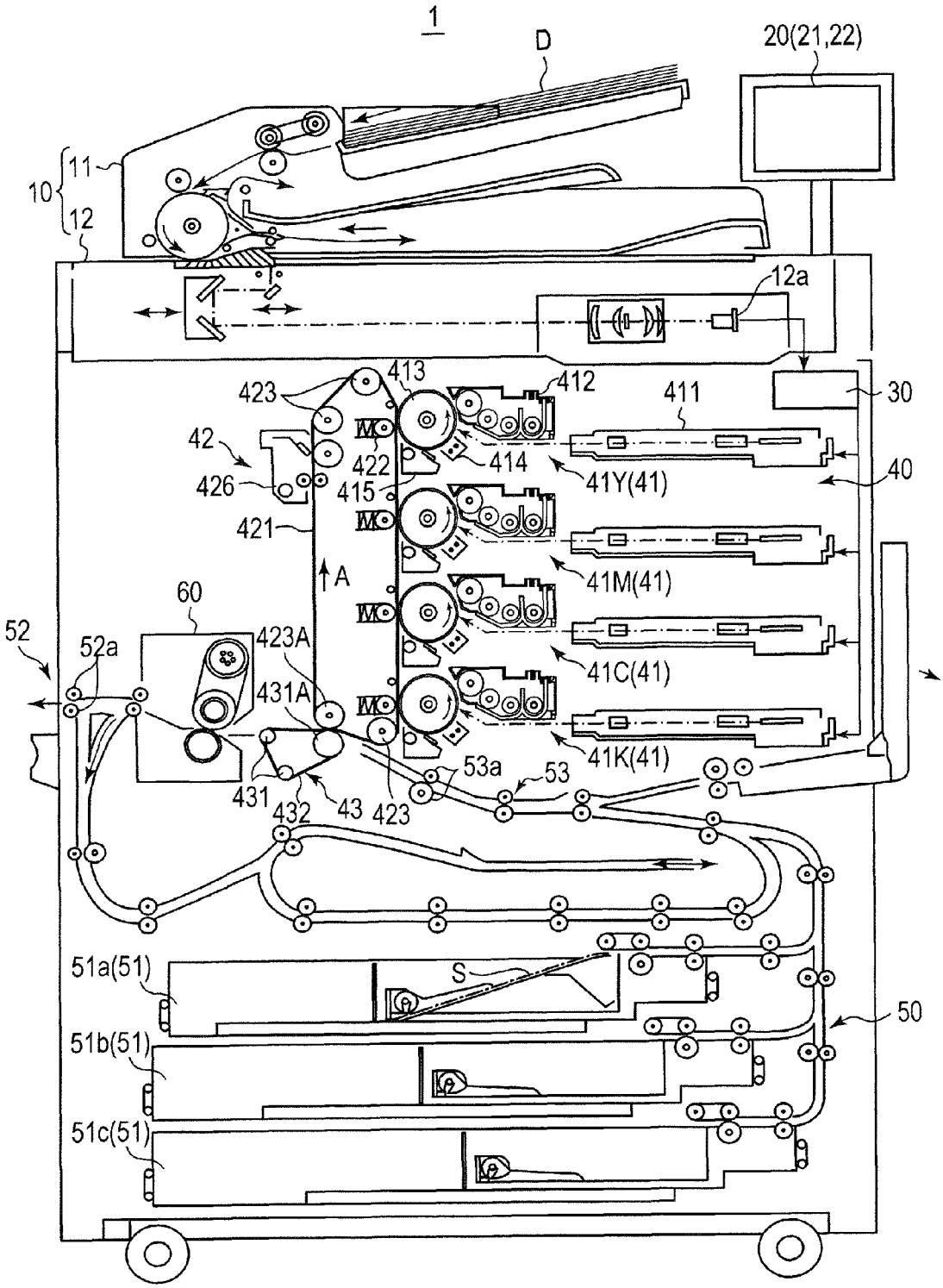
FIG. 1 schematically illustrates an overall configuration of an image forming apparatus according to an embodiment of the present invention.

FIG. 1 schematically illustrates an overall configuration of image forming apparatus 1 according to the embodiment of the present invention.

Image forming apparatus 1 illustrated in FIG. 1 is a color image forming apparatus with an intermediate transfer system using electrophotographic process technology. That is, image forming apparatus 1 transfers (primarily transfers) respective toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondarily transfers) the resultant image to sheet S, to thereby form an image.

A tandem system is adopted for image forming apparatus 1. In the tandem system, photoconductor drums 413 corresponding to the four respective colors of YMCK are placed in series in the running direction of intermediate transfer belt 421, and the toner images of the four colors are sequentially transferred to intermediate transfer belt 421 in one cycle.

As illustrated in FIG. 1, image forming apparatus 1 includes image reading section 10, operation/display section 20, image processing section 30, image forming section 40, sheet conveying section 50, and fixing section 60.

Image reading section 10 includes auto document feeder (ADF) 11, document image scanner 12 and the like.

Auto document feeder 11 causes a feeding mechanism to feed document D placed on a document tray, and sends out document D to document image scanner 12. Auto document feeder 11 enables images of a large number of documents D (including images on both sides of document D) set on the document tray to be successively read at once.

Document image scanner 12 optically scans a document fed from auto document feeder 11 to its contact glass or a document set on its contact glass, and images light reflected from the document on the light receiving surface of a charge coupled device (CCD) sensor 12*a*, to thereby read the document image. Image reading section 10 generates input image data on the basis of reading results provided by document image scanner 12. Image processing section 30 performs predetermined image processing on the input image data.

Operation/display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from a control section (not illustrated). Operation section 22 includes various operation keys such as a numeric key pad and a start key, receives various input operations performed by a user, and outputs operation signals to the control section (not illustrated).

Image processing section 30 includes a circuit that performs digital image processing suited to initial settings or user settings, on the input image data, and the like. For example, image processing section 30 performs toner correction on the basis of toner correction data (toner correction table), under the control of the control section (not illustrated). In addition to the toner correction, image processing section 30 also performs various correction processes such as color correction and shading correction, a compression process, or the like on the input image data. Image forming section 40 is controlled on the basis of the image data that has been subjected to these processes.

Image forming section 40 includes: image forming units 41Y, 41M, 41C, and 41K for forming images of colored toners respectively containing a Y component, an M component, a C component, and a K component on the basis of the input image data; intermediate transfer unit 42; secondary transfer unit 43; and the like.

Image forming units 41Y, 41M, 41C, and 41K for the Y component, the M component, the C component, and the K component, respectively, have a similar configuration. For ease of illustration and description, common elements are denoted by the same reference signs. Only when the elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, and drum cleaning device 415, and the like.

Photoconductor drum 413 is, for example, a negative charge type organic photoconductor (OPC) formed by sequentially laminating an under coat layer (UCL), a charge generation layer (CGL), and a charge transport layer (CTL) on the circumferential surface of a conductive cylindrical body (aluminum elementary tube) that is made of aluminum and has a drum diameter of 80 mm.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposing device 411. The charge transport layer is made of a layer in which a hole transporting material (electron-donating nitrogen compound) is dispersed in a resin binder (for example, polycarbonate resin), and transports the positive charge generated in the charge generation layer to the surface of the charge transport layer.

Photoconductor drum 413 is connected to a driving motor (not illustrated) through a power transmission mechanism (not illustrated). The control section (not illustrated) controls a driving current of the driving motor, whereby photoconductor drum 413 is rotated at a constant circumferential speed.

Charging device 414 evenly negatively charges the surface of photoconductor drum 413.

Exposing device 411 is composed of, for example, a semiconductor laser, and irradiates photoconductor drum 413 with laser light corresponding to the image of each color component. Because the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 is of, for example, a two-component development system. Developing device 412 attaches the toner of each color component to the surface of photoconductor drum 413, and thus visualizes the electrostatic latent image to form a toner image.

Drum cleaning device 415 includes, for example, drum cleaning blade 91 that is brought into sliding contact with the surface of photoconductor drum 413, and removes residual toner that remains on the surface of photoconductor drum 413 after primary transfer.

Figure 2:
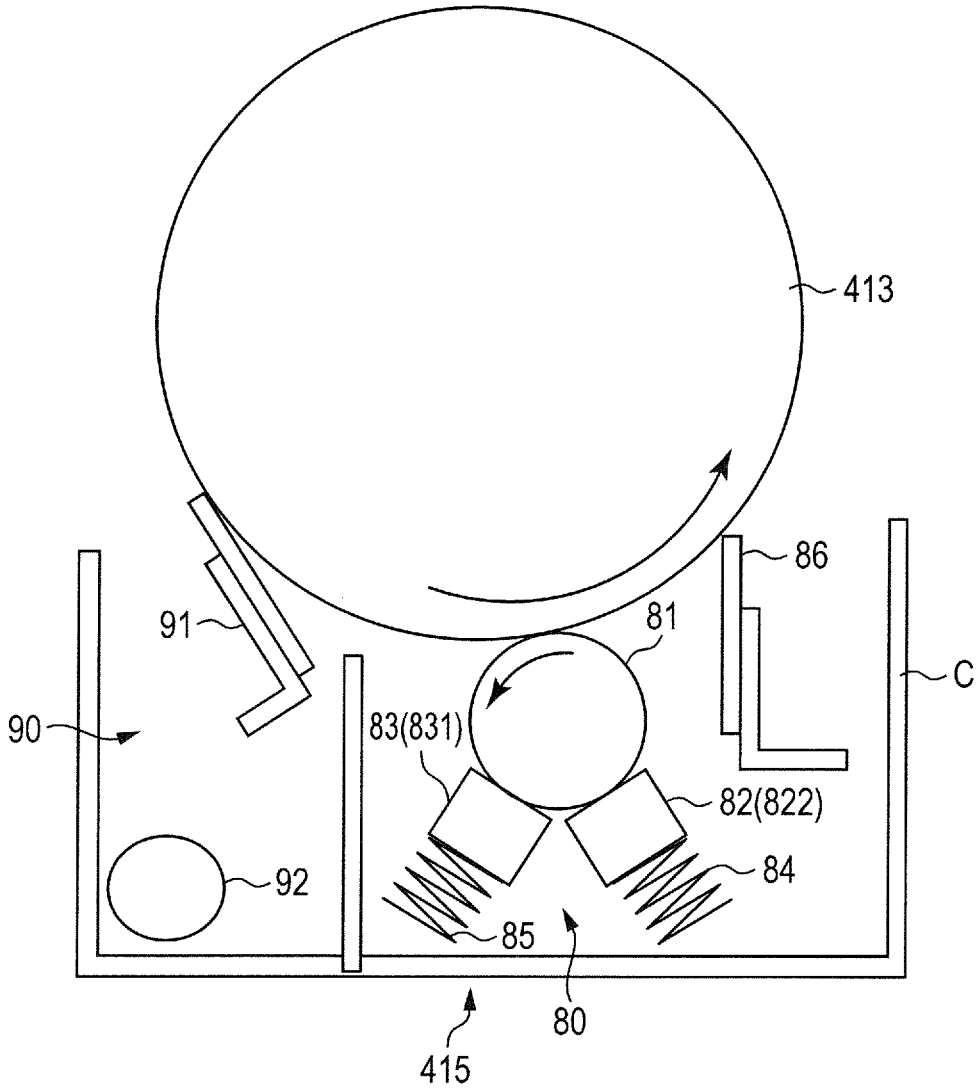
FIG. 2 illustrates a main part configuration of a drum cleaning device.

Drum cleaning device 415 includes cleaning section 90 and lubricant applying section 80 (see FIG. 2). Cleaning section 90 includes, for example, drum cleaning blade 91 that is brought into sliding contact with the surface of photoconductor drum 413, and removes residual toner that remains on the surface of photoconductor drum 413 after primary transfer.

Lubricant applying section 80 includes, for example, lubricant applying brush 81 that is brought into sliding contact with the surface of photoconductor drum 413, and applies a lubricant to the surface of photoconductor drum 413. Details of drum cleaning device 415 will be described later.

Intermediate transfer unit 42 includes, for example, intermediate transfer belt 421 that functions as an intermediate transfer member, a plurality of support rollers 423 including backup roller 423A, and belt cleaning device 426.

Intermediate transfer belt 421 is composed of an endless belt, and is stretched on the plurality of support rollers 423 in a loop-like manner. At least one of the plurality of support rollers 423 is composed of a driving roller, and the others are each composed of a driven roller. Support roller 423 that functions as the driving roller rotates, whereby intermediate transfer belt 421 runs at a constant speed in the arrow A direction. Intermediate transfer belt 421 is brought into pressurized contact with photoconductor drums 413 by primary transfer rollers 422, whereby the respective toner images of the four colors are sequentially primarily transferred to intermediate transfer belt 421 so as to be superimposed on each other.

Secondary transfer unit 43 has a configuration in which secondary transfer belt 432 is stretched on a plurality of support rollers 431 including secondary transfer roller 431A in a loop-like manner.

Secondary transfer roller 431A is brought into pressurized contact with backup roller 423A across intermediate transfer belt 421 and secondary transfer belt 432, whereby a transfer nip is formed. When sheet S passes through the transfer nip, the toner images carried by intermediate transfer belt 421 are secondarily transferred to sheet S. Specifically, a voltage (transfer bias) having a polarity opposite to that of the toner is applied to secondary transfer roller 431A, whereby the toner images are electrostatically transferred to sheet S. Sheet S to which the toner images have been transferred is conveyed to fixing section 60 by secondary transfer belt 432.

Belt cleaning device 426 includes, for example, a belt cleaning blade that is brought into sliding contact with the surface of intermediate transfer belt 421, and removes residual toner that remains on the surface of intermediate transfer belt 421 after secondary transfer.

Fixing section 60 heats and pressurizes sheet S conveyed thereto at its fixing nip, to thereby fix the toner images to sheet S. Fixing section 60 may include an air separation unit that blows air to thereby separate sheet S from a member on the fixing side (for example, a fixing belt) or a support member on the rear side (for example, a pressure roller).

Sheet conveying section 50 includes sheet feed section 51, sheet ejection section 52, conveyance route section 53, and the like.

Three sheet feed tray units 51*a* to 51*c* included in sheet feed section 51 house sheets S (standard sheets, special sheets) discriminated on the basis of the basis weight, the size, and the like, for each type set in advance.

Conveyance route section 53 includes a plurality of paired conveyance rollers such as paired paper stop rollers 53*a*. Sheets S housed in sheet feed tray units 51*a* to 51*c* are send out one by one from the topmost sheet, and are conveyed to image forming section 40 by conveyance route section 53. At this time, a paper stop roller section including paired paper stop rollers 53*a* corrects the inclination of sheet S fed thereto, and adjusts conveyance timing thereof.

Then, image forming section 40 collectively secondarily transfers the toner images on intermediate transfer belt 421 to one surface of sheet S, and fixing section 60 performs a fixing process thereon. Sheet S on which an image has been formed is ejected to the outside of the apparatus by sheet ejection section 52 including ejection rollers 52*a*.

As described above, image forming apparatus 1 includes: photoconductor drum 413; charging device 414 that uniformly charges the surface of photoconductor drum 413; exposing device 411 that forms an electrostatic latent image on the surface of photoconductor drum 413 through irradiation with light; developing device 412 that attaches toner to the surface of photoconductor drum 413 and thus visualizes the electrostatic latent image to form a toner image; and drum cleaning device 415 that removes residual toner that remains on the surface of photoconductor drum 413 after primary transfer.

FIG. 2 illustrates a main part configuration of drum cleaning device 415 according to the embodiment. In FIG. 2, drum cleaning device 415 is taken from the near side.

As illustrated in FIG. 2, drum cleaning device 415 includes cleaning section 90 and lubricant applying section 80. Components of cleaning section 90 and lubricant applying section 80 are attached by an appropriate method to case C serving as the framework of drum cleaning device 415.

Cleaning section 90 includes drum cleaning blade 91, toner collecting screw 92 and the like.

Drum cleaning blade 91 is an elastic member formed by shaping urethane rubber or the like into a tabular shape, and has a width substantially equal to the width in the axial direction (main scanning direction) of photoconductor drum 413. Drum cleaning blade 91 has a predetermined free length (for example, 9 mm), and is placed in sliding contact with photoconductor drum 413 at a predetermined abutment angle (for example, 15°) and a predetermined normal load (for example, 20 N) in a counter direction (i.e., a direction in which the edge of the cleaning blade is directed against the rotational direction of photoconductor drum 413).

During image formation, residual toner that remains on the surface of photoconductor drum 413 is scraped by drum cleaning blade 91 while photoconductor drum 413 is rotated. The scraped residual toner is sent out by toner collecting screw 92 to a waste toner collecting container (not illustrated).

Lubricant applying section 80 includes, for example, lubricant applying brush 81, solid lubricants 82 and 83, lubricant pressing sections 84 and 85, and leveling blade 86.

Lubricant applying brush 81 is, for example, a roller-shaped brush formed by winding around a core bar a base fabric including polyester fibers and the like interwoven therewith, and has a width substantially equal to the width in the axial direction of photoconductor drum 413. In the present embodiment, lubricant applying brush 81 has an outer diameter of 14 mm.

Lubricant applying brush 81 is fixed such that the surface of photoconductor drum 413 pushes the brush tips by a predetermined amount (for example, a biting amount of 0.5 to 1.5 mm), and is rotated in the direction opposite to the rotation direction of photoconductor drum 413.

Solid lubricants 82 and 83 are obtained by solidifying a lubricant so as to have a hardness equivalent to F to HB in terms of pencil hardness, and are respectively fixed to holders (not illustrated) of lubricant pressing sections 84 and 85. Examples of the used lubricant include zinc stearate (ZnSt).

Lubricant pressing sections 84 and 85 each, for example, include a biasing member such as a compression spring, and respectively press solid lubricants 82 and 83 fixed to one ends of the biasing members thereof, against lubricant applying brush 81 at a predetermined pressing force.

Leveling blade 86 has a configuration similar to that of drum cleaning blade 91. Leveling blade 86 is placed in sliding contact with photoconductor drum 413 at a predetermined abutment angle (for example, 50°) and a predetermined amount of invasion in a trailing direction (i.e., a direction in which the edge of the leveling blade is trailed during the rotation of photoconductor drum 413).

During image formation, lubricant applying brush 81 is rotated to thereby scrape the lubricant from the surface of each of solid lubricants 82 and 83, and the scraped lubricant is applied to the surface of photoconductor drum 413 in a contact portion with photoconductor drum 413. The applied lubricant is then leveled by leveling blade 86 to have a uniform thickness.

Figure 3:
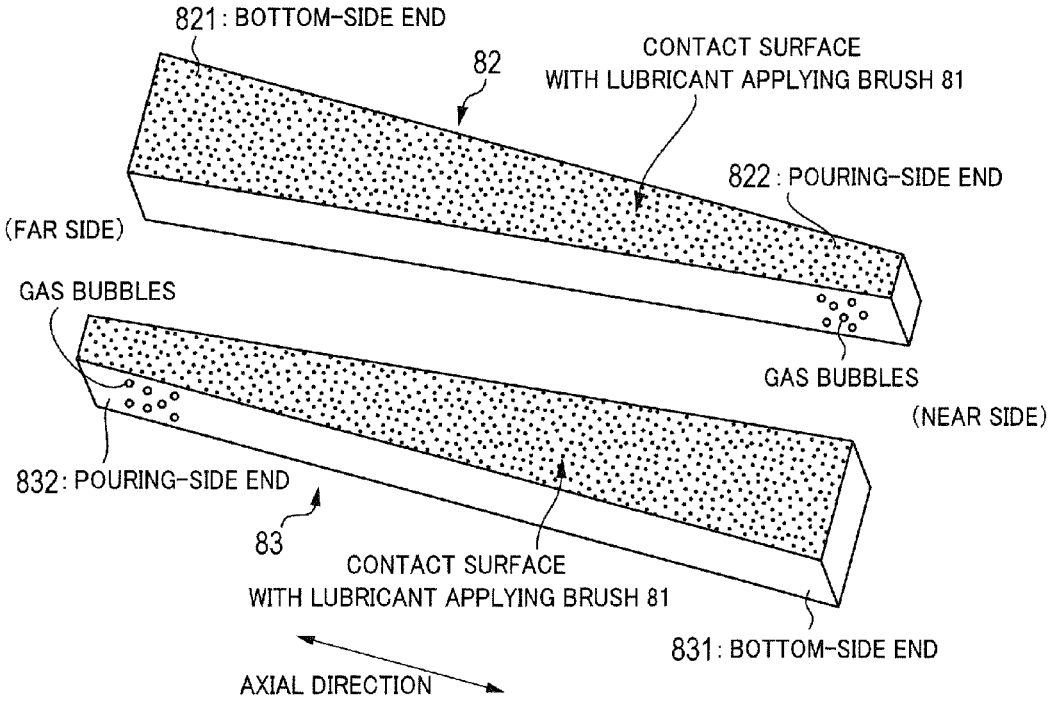
FIG. 3 illustrates a placement mode of two solid lubricants.

FIG. 3 illustrates a placement mode of solid lubricants 82 and 83. As illustrated in FIG. 3, in the present embodiment, two solid lubricants 82 and 83 are placed for one lubricant applying brush 81. Solid lubricants 82 and 83 are columnar solid lubricants each containing a larger number of residual gas bubbles at pouring-side end 822 or 832 than at bottom-side end 821 or 831, and are each placed in parallel to the axial direction of photoconductor drum 413.

For example, in the case where solid lubricants 82 and 83 are produced by the gravity casting method, bottom-side ends 821 and 831 of solid lubricants 82 and 83 are formed in solid form. In contrast, in pouring-side ends 822 and 832, gas bubbles remain trapped, and so-called blowholes occur. Note that, if solid lubricants 82 and 83 are produced by the same production method, remaining conditions of the gas bubbles may be considered to be the same.

In the present embodiment, solid lubricants 82 and 83 are placed such that bottom-side end 821 of one solid lubricant 82 is opposed to pouring-side end 832 of the other solid lubricant 83 and that pouring-side end 822 of one solid lubricant 82 is opposed to bottom-side end 831 of the other solid lubricant 83. That is, two solid lubricants 82 and 83 are placed such that bottom-side ends 821 and 831 and pouring-side ends 822 and 832 are opposite to each other.

Focusing on only one of solid lubricant 82 and solid lubricant 83, the lubricant density of pouring-side end 822 or 832 is lower than that of bottom-side end 821 or 831 due to the occurrence of the blowholes, but the lubricant density in the axial direction is averaged as a whole by placing two solid lubricants 82 and 83 in opposite directions. Accordingly, the lubricant is uniformly applied in the axial direction of photoconductor drum 413.

It is preferable to form solid lubricants 82 and 83 such that cross-sectional areas thereof perpendicular to the axial direction decrease from bottom-side ends 821 and 831 to pouring-side ends 822 and 832.

In the case where solid lubricants 82 and 83 are produced by the gravity casting method, the solidification proceeds from the outer side to the inner side as taken in cross-sections perpendicular to the axial directions, and hence gas bubbles are more likely to remain at the center portions. Because the cross-sectional areas of pouring-side ends 822 and 832 are set to be smaller than those of bottom-side ends 821 and 831, gas bubbles can escape more easily from the surfaces during solidification of a liquid resin, and hence gas bubbles that remain trapped in solid lubricants 82 and 83 can be reduced. That is, the lubricant density of each of solid lubricants 82 and 83 is made uniform, and hence the present embodiment is advantageous in uniformly applying the lubricant to photoconductor drum 413.

As described above, image forming apparatus 1 includes: photoconductor drum 413 (image bearing member) on which a toner image is formed electrophotographically; and lubricant applying section 80 that applies a lubricant to the surface of photoconductor drum 413. Lubricant applying section 80 includes two columnar solid lubricants 82 and 83 containing a larger number of residual gas bubbles at pouring-side end 822 and 832 (one end) than at bottom-side end 821 and 831 (the other end), respectively, solid lubricants 82 and 83 being formed by the same production method. Then, two solid lubricants 82 and 83 are placed in parallel to the axial direction of photoconductor drum 413 such that bottom-side ends 821 and 831 and pouring-side ends 822 and 832 are opposite to each other.

According to image forming apparatus 1, even if gas bubbles remain in solid lubricants 82 and 83, because the densities of solid lubricants 82 and 83 in the axial direction are averaged as a whole, the lubricant can be uniformly applied to photoconductor drum 413.

It is therefore not necessary to completely remove gas bubbles, and hence solid lubricants 82 and 83 that are produced at low costs by the gravity casting method as with the conventional ones can be applied. Further, even if the thicknesses of solid lubricants 82 and 83 are increased and gas bubbles are thus more likely to occur during production, a problem does not arise.

Accordingly, the durability and reliability of image forming unit 41 (photoconductor drum unit) can be improved, and higher image quality can be achieved.

Hereinabove, the invention made by the present inventors has been specifically described by way of the embodiment. The present invention is not limited to the embodiment, and can be changed within a range not departing from the gist thereof.

For example, solid lubricants 82 and 83 are not limited to lubricants produced by the gravity casting method, and may be produced by other production methods. That is, the present invention can be applied to cases where such solid lubricants are used that contain a larger number of residual gas bubbles at one end than at the other end thereof in the axial direction, and that are produced by the same production method.

Figure 4:
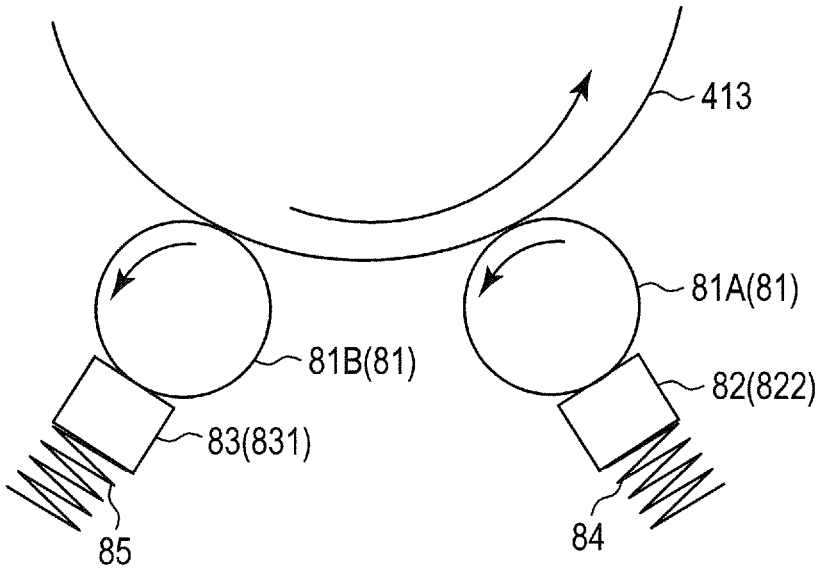
FIG. 4 illustrates a modified example of a lubricant applying section.
Figure 5:
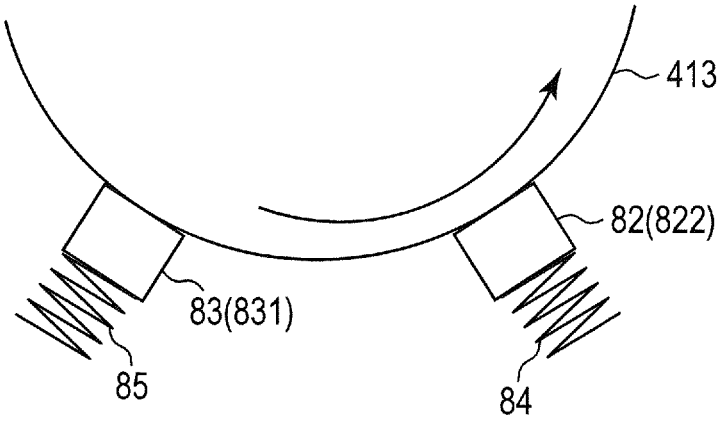
FIG. 5 illustrates another modified example of the lubricant applying section.

As illustrated in FIG. 4, lubricant applying brushes 81A and 81B may be placed respectively for solid lubricants 82 and 83. Alternatively, as illustrated in FIG. 5, lubricant applying brush 81 may not be provided, and solid lubricants 82 and 83 may be brought into direct contact with photoconductor drum 413.

The present invention can be applied to an image forming apparatus including a lubricant applying section that applies a lubricant to intermediate transfer belt 421 serving as an image bearing member.

The embodiment disclosed above should be considered to be given as an example in all respects and not to limit the present invention. The scope of the present invention is defined by not the above description but the appended claims, and the present invention encompasses meaning equivalent to the appended claims and all changes not departing from the appended claims.

What is claimed is:

1. An image forming apparatus comprising: an image bearing member configured to form thereon a toner image; and a lubricant applying section that applies a lubricant to a surface of the image bearing member, wherein the lubricant applying section includes two columnar solid lubricants each containing a larger number of residual gas bubbles at one end than at the other end thereof, the two solid lubricants being produced by the same production method, and the two solid lubricants are placed in parallel with an axial direction of the image bearing member such that the respective one ends and the other ends thereof are opposite to each other in the axial direction.

2. The image forming apparatus according to claim 1, wherein the two solid lubricants are formed by a gravity casting method, and are placed such that respective pouring-side ends and bottom-side ends thereof are opposite to each other.

3. The image forming apparatus according to claim 2, wherein cross-sectional areas of the two solid lubricants perpendicular to the axial direction decrease from the bottom-side ends to the pouring-side ends.

* * * * *